US008104575B1

(12) United States Patent
Bancroft

(10) Patent No.: US 8,104,575 B1
(45) Date of Patent: Jan. 31, 2012

(54) SUPPORT PAD APPARATUS

(76) Inventor: Russell N. Bancroft, Simi Valley, CA (US)

( * ) Notice: Subject to any disclaimer, the term of this patent is extended or adjusted under 35 U.S.C. 154(b) by 560 days.

(21) Appl. No.: 12/317,570

(22) Filed: Dec. 29, 2008

Related U.S. Application Data

(63) Continuation-in-part of application No. 11/436,945, filed on May 19, 2006, now abandoned.

(51) Int. Cl.
*E04D 15/00* (2006.01)

(52) U.S. Cl. ..... 182/45; 52/749.12

(58) Field of Classification Search ..... 182/45, 182/230; 52/749.12
See application file for complete search history.

(56) References Cited

U.S. PATENT DOCUMENTS

| | | | | |
|---|---|---|---|---|
| 548,694 | A | 10/1895 | Breul | |
| 2,061,664 | A * | 11/1936 | Lincoln | 5/653 |
| 2,708,543 | A | 5/1955 | Matich | |
| 5,119,904 | A * | 6/1992 | Dierolf | 182/230 |
| 5,282,597 | A | 2/1994 | Babcock | |
| 5,415,109 | A | 5/1995 | McBride | |
| 5,730,245 | A | 3/1998 | Conway | |
| D461,564 | S | 8/2002 | Neulieb | |
| 6,490,842 | B2 | 12/2002 | Emmons | |
| 2003/0037990 | A1 | 2/2003 | Testa, Jr. | |
| 2006/0191446 | A1 * | 8/2006 | Discacciati | 108/59 |

FOREIGN PATENT DOCUMENTS

GB 2131475 A * 6/1984

* cited by examiner

*Primary Examiner* — Alvin Chin Shue
(74) *Attorney, Agent, or Firm* — Larry F. Gitlin, Esq.; Beaumont Gitlin Tashjian

(57) ABSTRACT

A support pad apparatus, including a rigid platform and a load-spreading conformable pad thereunder that conforms to the bottom surface of the platform and may either be flat or concave along its bottom surface to engage the surface of a flat, uneven or sloped roof or some other type of flat, uneven or sloped hard or soft underlying surface, both within and outside of a building, or in any other appropriate setting. The top of the platform contains the structural means to ensure that the person working, standing or walking upon the platform is able to maintain a secure, stable, and balanced footing.

16 Claims, 9 Drawing Sheets

SUPPORT PAD APPARATUS

This is a continuation-in-part of application Ser. No. 11/436,945 filed May 19, 2006, now abandoned.

BACKGROUND OF THE INVENTION

In the construction and related trades, it is necessary in almost every situation to provide protection to the surfaces located nearby and adjacent to the work locations and the pathways leading to and from these locations. Examples are, without limitation, locations within buildings, including flat and sloped tile, wood, carpet and stone floor surfaces, and outside buildings, including flat and sloped ground surfaces comprised of softscape, e.g. grass (natural and synthetic), and flat and sloped tile, wood, and stone and a wide variety of other natural and synthetic deck and outdoor surfaces. Flat and sloped roof surfaces require the same kind of protection.

A building's roof is intended to keep out the heat of the sun, the chill of the wind, and precipitation. A long roof-life is desirable in order to avoid the inconvenience and the damage that can result from a leaky roof and the usually associated high cost of repair and maintenance. Many roofing materials, which normally have a long life-span even when they are exposed to the damaging effects of sunlight and precipitation, can still become desiccative and extremely brittle over time. Brittle roofing materials can include natural materials, such as slate, and also man-made materials constructed of synthetic or inorganic components. Some man-made materials designed to be used instead of slate, such as those that are cement or oil based, or wood, can become extremely brittle as well. Roofing surface materials, even those that tend not to become as brittle as some others, e.g. composition shingle and metal, still require protection from damage in the process of installing, repairing or maintaining a flat or sloping roof surface.

Accordingly, a suitable apparatus is necessary for distributing the load of a person's weight and the weight of any materials or equipment that person might be carrying to permit such person to walk about and work without causing damage to the underlying surface. This apparatus needs to be stable and provide a safe and reliable working platform upon which a person may walk and work in any direction properly balanced while protecting the underlying surfaces, as described heretofore.

SUMMARY OF THE INVENTION

In order to aid in the understanding of this invention, it can be stated in essentially summary form that the invention is directed to a support pad apparatus, which includes a fairly rigid platform, which may be flat or slightly convex, with a load-spreading pad thereunder that conforms to the bottom surface of the platform and may either be flat or concave along its bottom surface to engage the surface of a flat, uneven or sloped roof or some other type of flat, uneven or sloped hard or soft underlying surface, both within and outside of a building, or in any other appropriate working environment. The top of the platform contains the structural means to ensure that the person working or walking upon the platform is able to maintain a secure, stable, and balanced footing on its surface.

Accordingly, it is a purpose and advantage of this invention to provide a support pad apparatus which is configured to lay upon a fragile, brittle or any other type of sloped, uneven or flat underlying surface and assist in distributing the weight of a person walking upon the apparatus and the weight of any materials or equipment that person may be carrying in order to prevent damage to the underlying structure or surface, or its individual component elements.

It is a further purpose and advantage of this invention to provide a support pad apparatus which is configured to lay upon a fragile, brittle or any other type of flat, uneven or sloped underlying surface and provide the means for a safe, secure and balanced footing for a person walking upon the underlying surface in any direction.

It is a further purpose and advantage of this invention to provide a support pad apparatus, which is configured to ensure enhanced stability and balance for a person when walking or working upon any type of flat, uneven or sloped surface that requires protection from damage or destruction.

It is a further purpose and advantage of this invention to provide a support pad apparatus which can be employed on sloped, flat or uneven surfaces, such as roofs and a wide variety of fragile and sometimes expensive indoor or outdoor hardscapes and softscapes, to ensure the protection, preservation and integrity of the underlying surfaces.

It is a further purpose and advantage of this invention to provide a support pad apparatus which can be used to support the weight of all kinds of items, including product inventory equipment and the like, placed in temporary or permanent storage.

It is a further purpose and advantage of this invention to provide a support pad apparatus structured to be lightweight, and which has one or more handholds so that it can be easily transported.

It is a further purpose and advantage of this invention to provide a support pad apparatus which has friction grit on the top of the platform to improve a person's traction and balance while walking upon the apparatus.

It is a further purpose and advantage of this invention to provide a support pad apparatus to provide the means for supporting a person's feet, for compensating for an uneven or sloped underlying surface, and enhancing a person's balance by leveling the person's body orientation.

It is a further purpose and advantage of this invention to provide a support pad apparatus which is configured so that several of the support pads can be attached together, either vertically or horizontally in a row, to provide a person a greater area upon which the person can move in any direction without walking directly upon or damaging the underlying surface.

The features of this invention, which are believed to be novel, are set forth with particularity in the appended claims. The present invention, both as its organization and manner of operation, together with further objects and advantages thereof, may be best understood by reference to the following description, taken in conjunction with the accompanying drawings.

DETAILED DESCRIPTION OF THE PREFERRED EMBODIMENT

Figure 1:
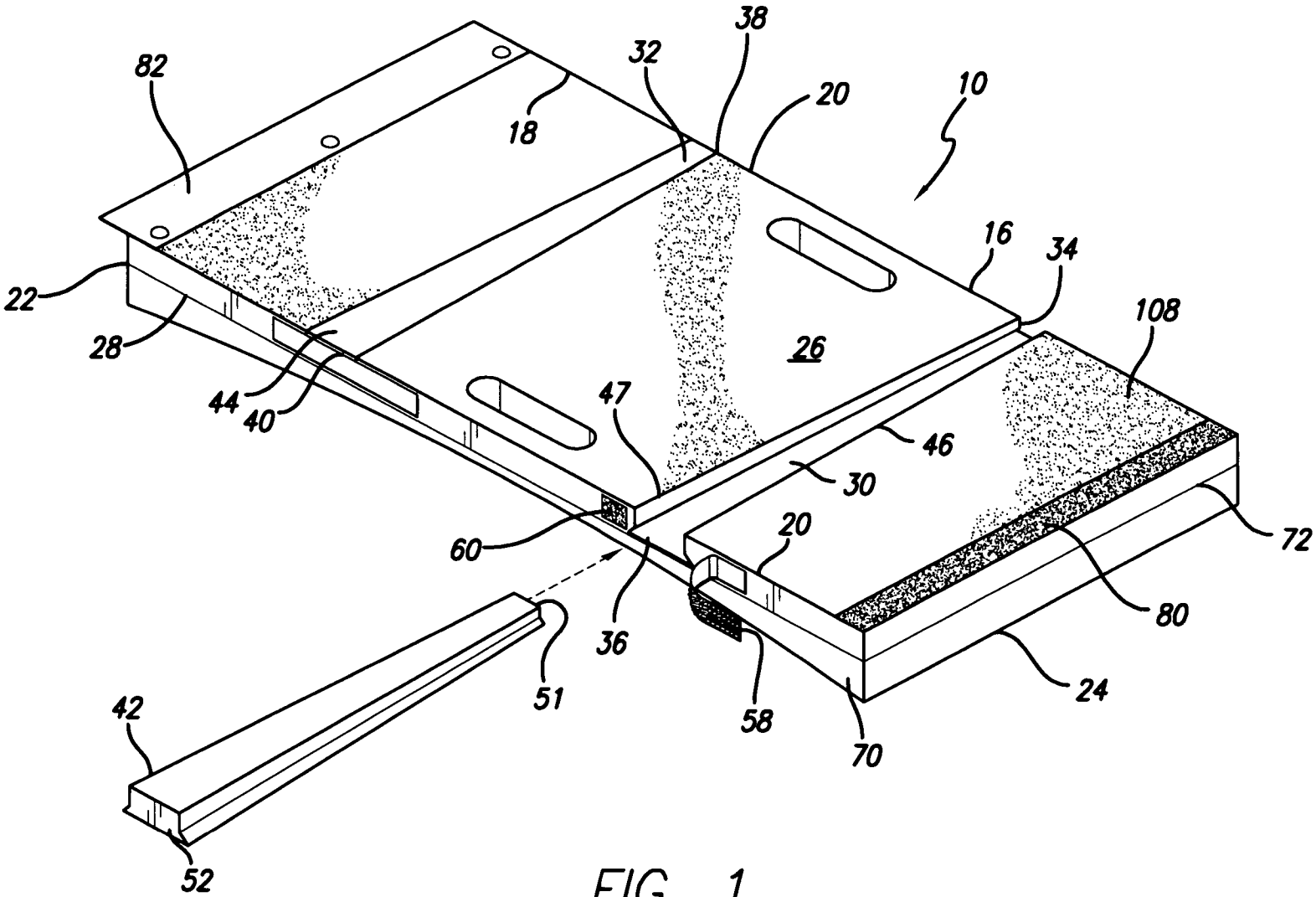
FIG. 1 is a perspective view of the support pad apparatus of the present invention.
Figure 2:
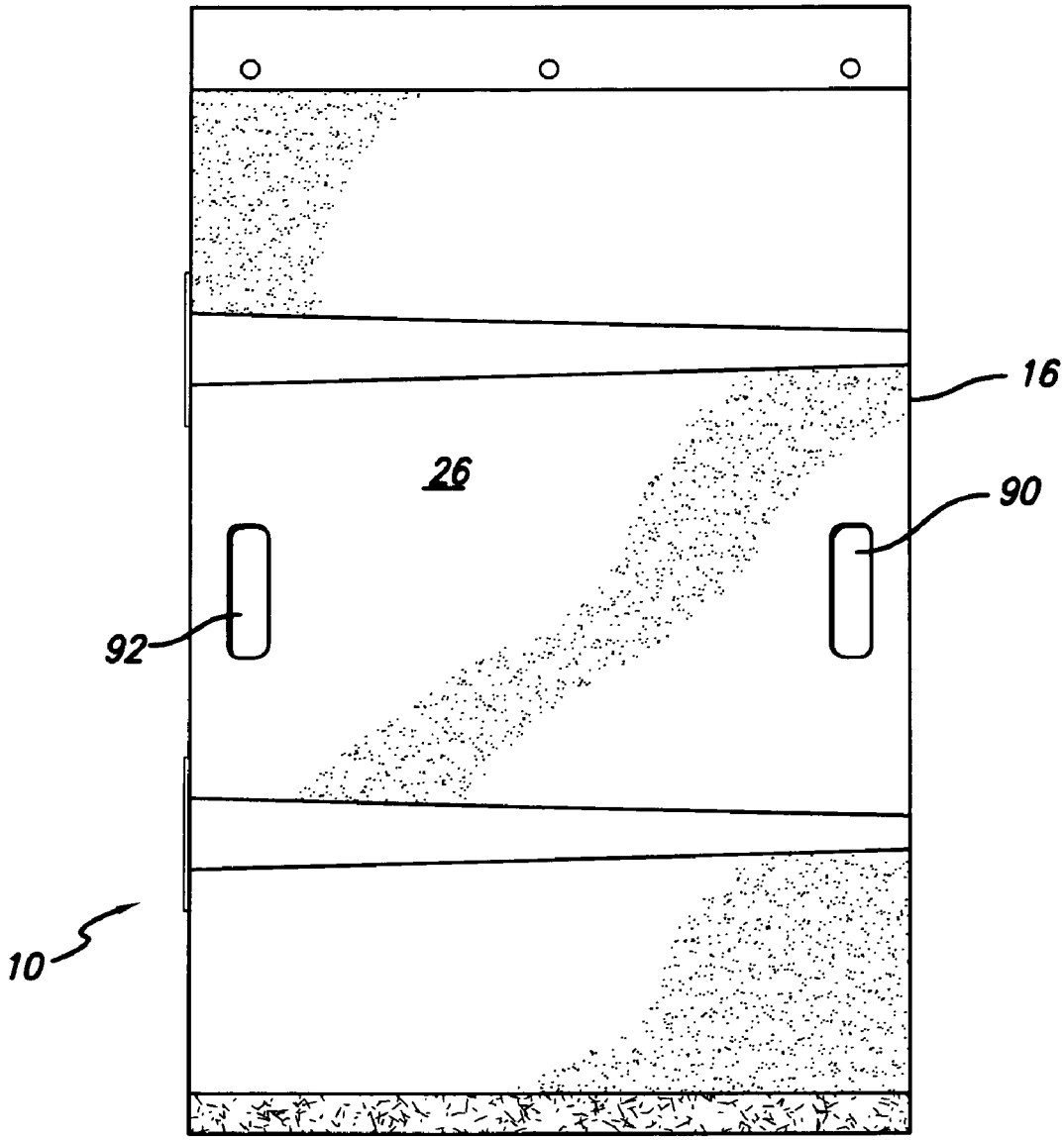
FIG. 2 is a top view of the support pad apparatus of the present invention.
Figure 3:
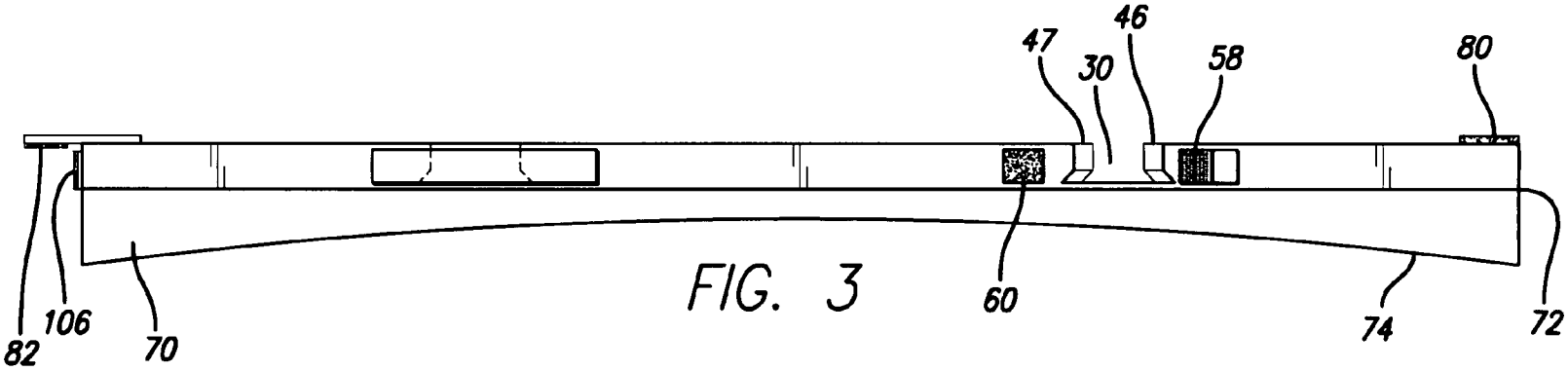
FIG. 3 is an elevational view of the support pad apparatus of the present invention shown from one side.
Figure 4:
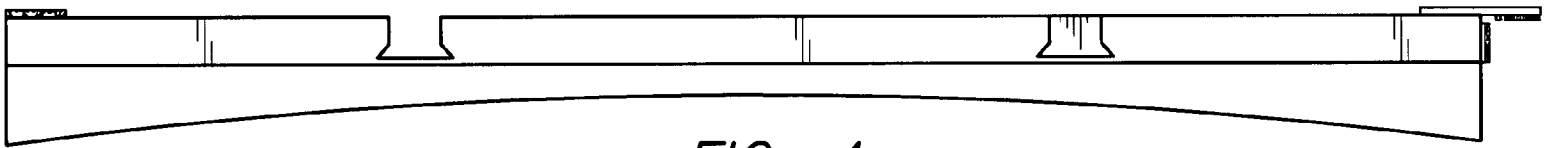
FIG. 4 is an elevational view of the support pad apparatus of the present invention shown from the opposite side.

The support pad apparatus of the present invention generally designated at 10 in FIG. 1 is particularly appropriate for use on various types of uneven, sloped and level surfaces. Examples are grass surfaces (FIG. 10) and other outdoor surfaces containing softscapes (natural and synthetic), such as grass, low-lying plants and other types of foliage; or hardscapes such as flat, uneven or sloped ground-level brickwork, stonework, low-lying outdoor statuary, and sculptural works, or above-ground decking constructed of a wide assortment of materials, including, without limitation, tile, wood, carpet (FIG. 11), synthetic grass and stone. The support pad also has applications as a platform on which to temporarily or permanently store items of all kinds while preserving the integrity of the underlying flooring surface.

Figure 5:
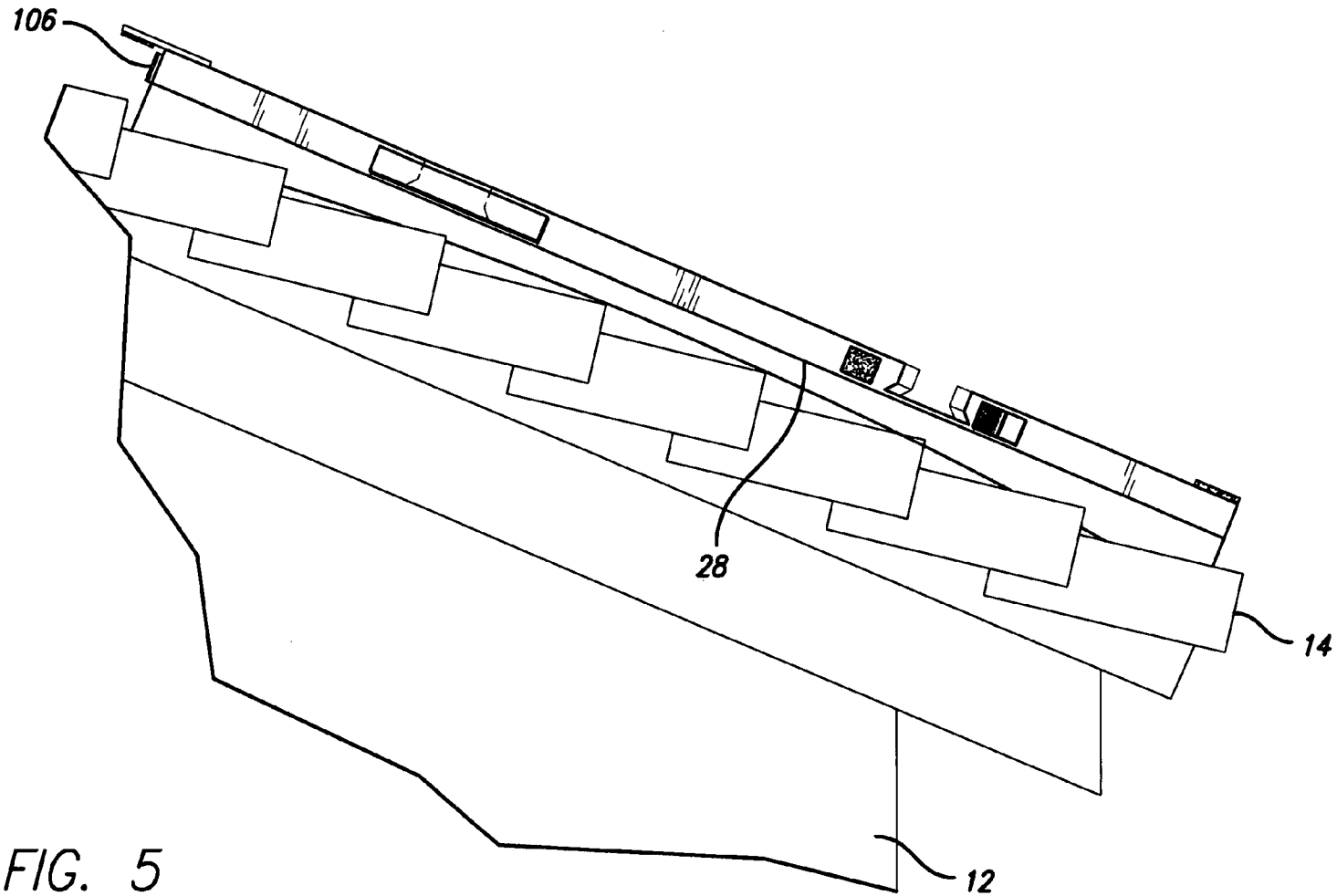
FIG. 5 is a perspective view of a broken away portion of a roof structure together with the support pad apparatus of the present invention, showing the manner in which the apparatus is deployed upon a roof.
Figures 6, 7:
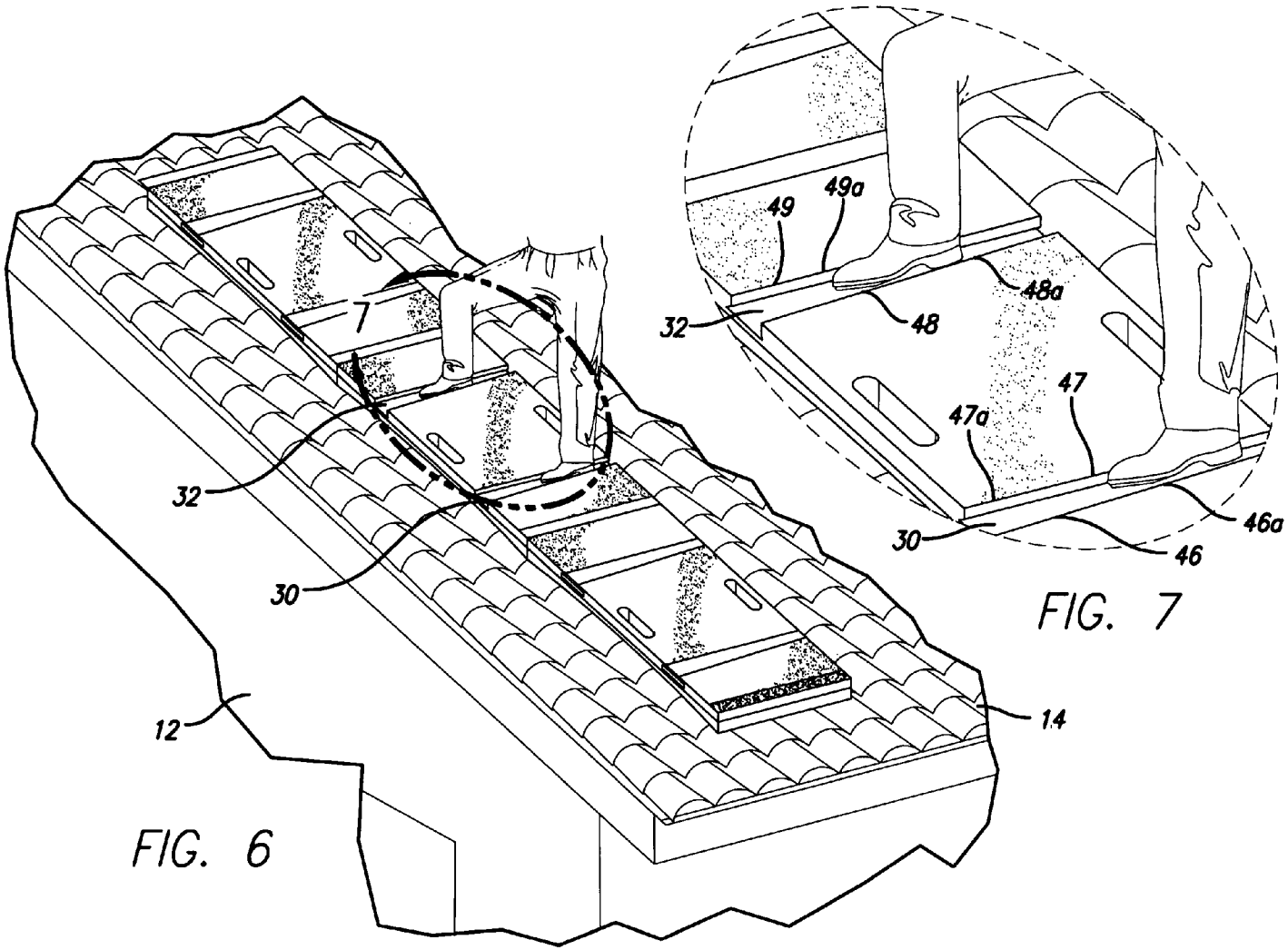
FIG. 6 is a perspective view of a broken away portion of a roof structure together with several vertically deployed and attached support pad apparatuses of the present invention, showing the placement of the person's feet against the foot supports and the person's body orientation.
FIG. 7 is an enlarged section taken generally along line 7-7 of FIG. 6, with parts broken away.

The support pad apparatus is also appropriate to provide the means to walk about and work upon roofs of buildings and preserve the integrity of their underlying surfaces. For example, the building shown in FIGS. 5 and 6 is any type of building structure with a roof wherein the contents must be protected from the effects of the weather, especially heat, wind and precipitation. The building, for example, may be a home, store, factory, warehouse or some other type of similar structure and is provided with a roof, which is designed and built to protect the structure's interior. The roof may be constructed of a myriad of conventional materials, some of which may be inherently fragile. Other types of roofs are constructed of materials that may not be inherently fragile or susceptible to easy breakage. Still, over time, with prolonged exposure to the elements, these roofs become more prone to damage than they were when they were originally installed. Materials that can be employed to construct the roof include, without limitation, tile (clay, cement, and metal), composition shingle (standard and dimensional), shake (natural or synthetic), metal (raised seam, flat, corrugated or profiled), and slate (natural and synthetic). A principal objective of the present invention is the protection of these types of roofs against the localized overloading of a person's weight combined possibly with the weight of any materials or equipment that person may be carrying when the person walks upon the roof surface, resulting in severe and usually costly damage to the roofs integrated component materials.

Accordingly, it is necessary to avoid direct heavily-weighted loads upon most types of roofs and, whenever possible, to distribute the weighted overload on the roof when a person walks and works upon its surface. The support pad apparatus of the present invention may be provided for use on flat, uneven and sloped roofs made of all kinds of materials to ensure that a person's walking load is spread sufficiently across the entire apparatus to avoid damage to the roofs surface.

The support pad apparatus, particularly when deployed on the surface of a sloped roof, must also provide a safe and reliable working platform for the person standing, walking and working on it. Consistent with this objective, the support pad must also provide the means to ensure that the person standing, walking and working on the pad can maintain the proper body balance, and that the risk of slipping or falling off the pad or off the roof entirely is absolutely minimized.

The preferred embodiment of the present invention is illustrated by reference to support pad apparatus 10, which forms the principal load distributing member and may be deployed upon a roof 14 (see FIGS. 5 and 6) or any hardscape or softscape (see FIGS. 10 and 11) situated in a wide variety of contexts to provide a platform on which a person can walk, stand, kneel or even recline to perform installations of all kinds, repair work, transportation tasks or the like, or upon which to support goods in storage, and which protects the underlying surface from damage. Platform 16 includes first side edge 18, second side edge 20, front end 22, back end 24, top working surface 26 and bottom surface 28, which may be flat or concave. Platform 16 also includes one or more horizontally disposed slots, such as, for example, slots 30 and 32, with each such slot having openings 34, 36, and 38, 40 at their respective ends. Each slot is preferably 3" in width at the top and 4" in width at the base. Various other combinations of these dimensions may also be suitable.

Key member 42, which conforms to the configuration of slot 30, is slidably insertable into slot 30 entering the slot by engaging it at opening 36. Key member 44, which conforms to the configuration of slot 32, is slidably insertable into slot 32 entering the slot by engaging it at opening 40. Foot supports 46, 47, and 48, 49 are formed along corresponding edges 46*a*, 47*a* and 48*a*, 49*a* of slots 30 and 32, respectively, and are used to give the person standing and working on the platform a stable and secure footing and a level body orientation appropriately tangential to the slope of the underlying roof surface to assist in maintaining a proper balance (see FIGS. 6 and 7).

Foot supports 46, 47 and 48, 49 enhance the support characteristics of the support pad by providing the means to ensure that the worker's body, particularly when standing and performing a task, is oriented in a more natural horizontal position. This enables the person to walk and work more safely on the apparatus with greater balance and with less risk of slippage or disorientation.

Slots 30 and 32 are tapered so that the width at one end is narrower or wider than the width at the opposite end, as the case may be. Key members 42 and 44 are tapered in conformal relationship with their respective slots.

Figure 10:
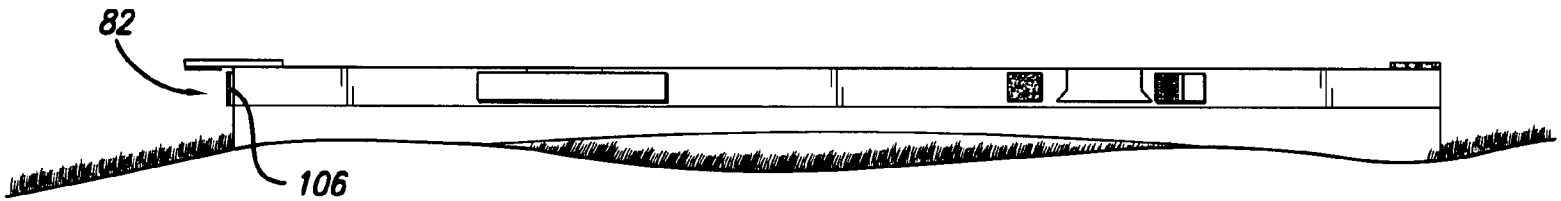
FIG. 10 is a side elevational view of the preferred embodiment of the support pad apparatus of the present invention deployed on an uneven grass surface.
Figure 11:
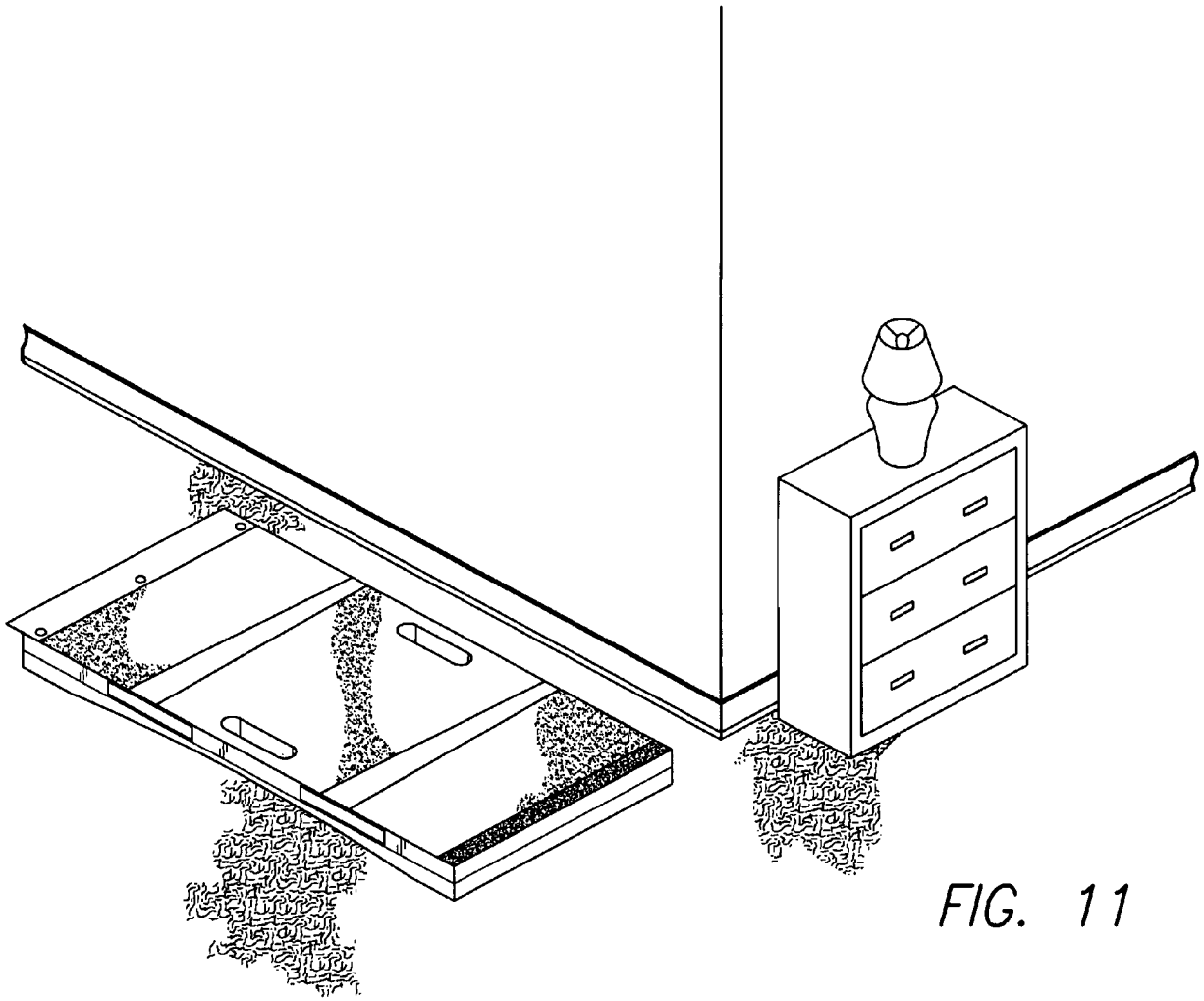
FIG. 11 is a perspective view of the preferred embodiment of the support pad apparatus of the present invention deployed on a carpeted surface inside a building.

When key members 42 and 44 are inserted into their respective slots, either slot 30 or slot 32, the combination of the two elements provide for a flat uninterrupted working surface on the platform. There are situations where this kind of platform is required, such as, for example, when the work involves a level or only slightly uneven surface not requiring the use of foot supports 46, 47 and 48, 49, such as a flat roof, the flooring inside a building or a level or slightly uneven ground surface in a backyard or some other type of outdoor environment (FIGS. 10 and 11).

Particular examples include grass surfaces and surfaces containing softscape, such as low-lying plants or other types of low-profile foliage; or hardscapes, such as ground level brickwork, stonework, low-lying outdoor statuary, and sculptural works, or above-ground decking made of wood or any other type of natural or synthetic material. In this embodiment, key members 42 and 44 are securely held tightly within their respective slots. Thus, for example, end 51 of the key member 42 is "wedged" into the corresponding tapered end of slot 30 and the end 52 of the key member 42 is prevented from slipping back out with the use of means to hold end 52 in place, such as, for example, VELCRO® material, also known by its generic components as hook and loop fasteners 58 and 60.

Platform 16 is typically constructed of materials consistent with the mechanical needs of a load distribution apparatus. A thick sheet of plywood or any suitable polymer-based material having a 2' width by a 4', 5', or 6' length is preferred for working surface applications or for use to support foot traffic. When used to accommodate storage or for staging applications and for use in equipment and material transport, the preferred dimensions for the platform are 4'×4', 4'×6' and 4'×8'.

Attached to bottom surface 28 of platform 16 is resilient pad 70, which is employed to spread the load of the weight of the platform and a person walking on it, including any item (equipment, products, etc.) that person might be carrying, and preferably is ½" to ¾" thick when deployed within an enclosed structure, and 1" to 1½" thick when deployed in an outdoor environment. Resilient pad 70 includes top surface 72 and pliable bottom surface 74, which can be flat, but also may be concave as the conditions may require. Pliable concave bottom surface 74 is adapted to more closely conform to the shape of the underlying surface, particularly when uneven, to provide stability and eliminate an unsettling fulcrum effect that could easily result from contact between a support pad apparatus with a rigid or inflexible flat bottom surface and an uneven underlying surface (see FIG. 10). Resilient pad 70 can be constructed from a large assortment of natural and synthetic materials, though a synthetic polymer composition foam material is generally preferred.

Platform 16 can be configured so that top surface 26 is flat, and bottom surface 28 is either flat or concave. Resilient pad 70, when joined with platform 16 having a concave bottom surface 28, conforms to the concave bottom surface either because of the conformable material employed or by actually shaping top surface 72 of resilient pad 70 in a mateable convex configuration.

Platform 16 is sufficiently rigid and resilient pad 70 sufficiently resilient so that the load created by a person's weight and/or any materials, equipment, or consumer or other goods the person is transporting or working with is distributed more evenly and the underlying working surface is not damaged.

Platform 16 and resilient pad 70 are joined together with some type of suitable adhesive or with the use of any other conventional attachment means commonly employed for this purpose.

Support pad apparatus 10 needs to be easily and comfortably carried to and from the job site or wherever else it may have application. It is for this reason that 2'×4', 2'×5', and 2'×6' configurations are desirable. Hand grips 90 and 92 are formed as slots through platform 16 usually at its midpoint and adjacent its edges. The hand grips are each sized sufficiently large to accommodate almost any size hand. It should be noted that in any embodiment of the present invention resilient pad 70 may include notches 94 and 96 (see FIG. 8) corresponding to the hand grip slots 90 and 92. Notches 94 and 96 may be omitted, as desired.

Figure 8:
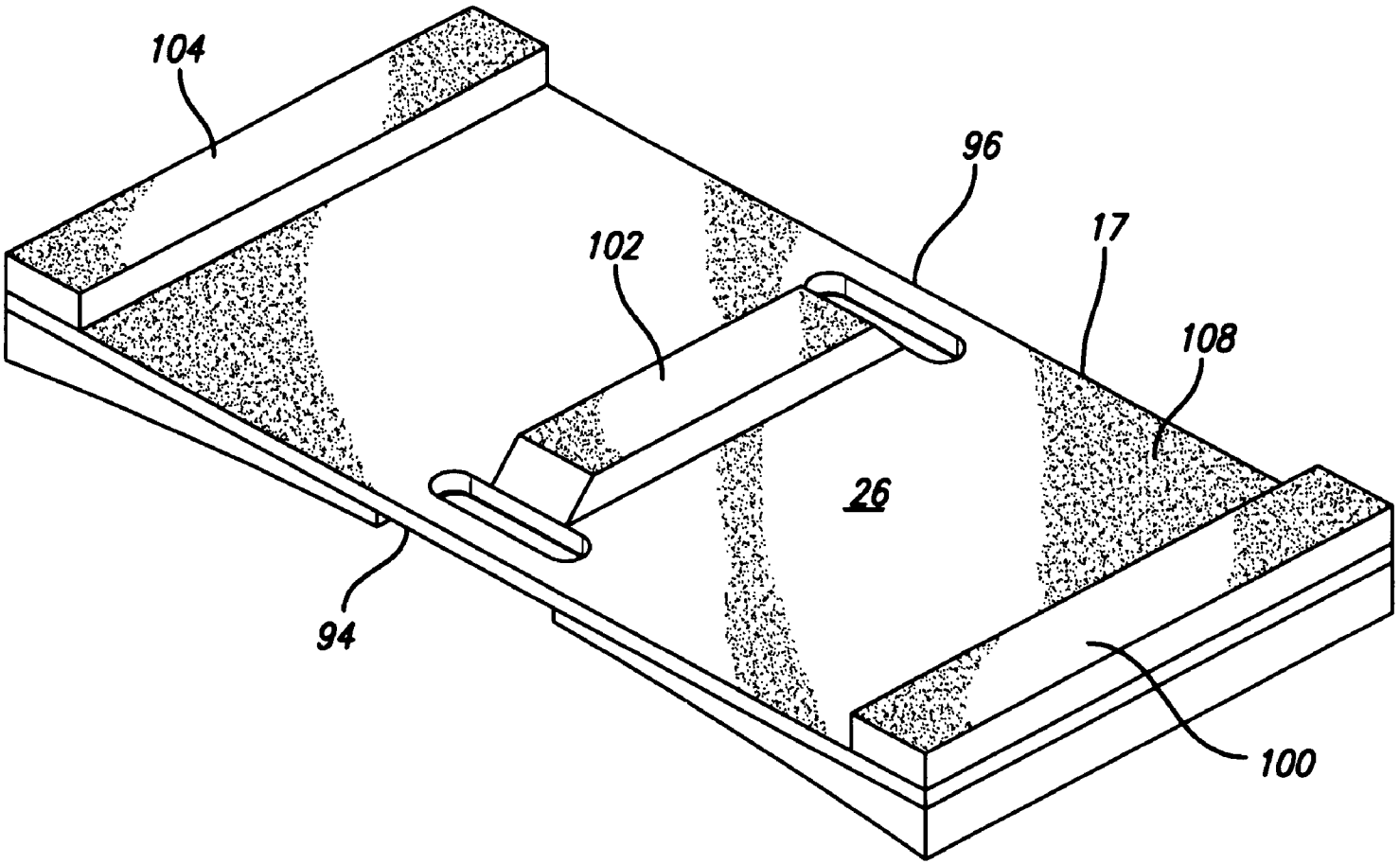
FIG. 8 is a perspective view of an alternative embodiment of the support pad apparatus of the present invention.
Figure 9:
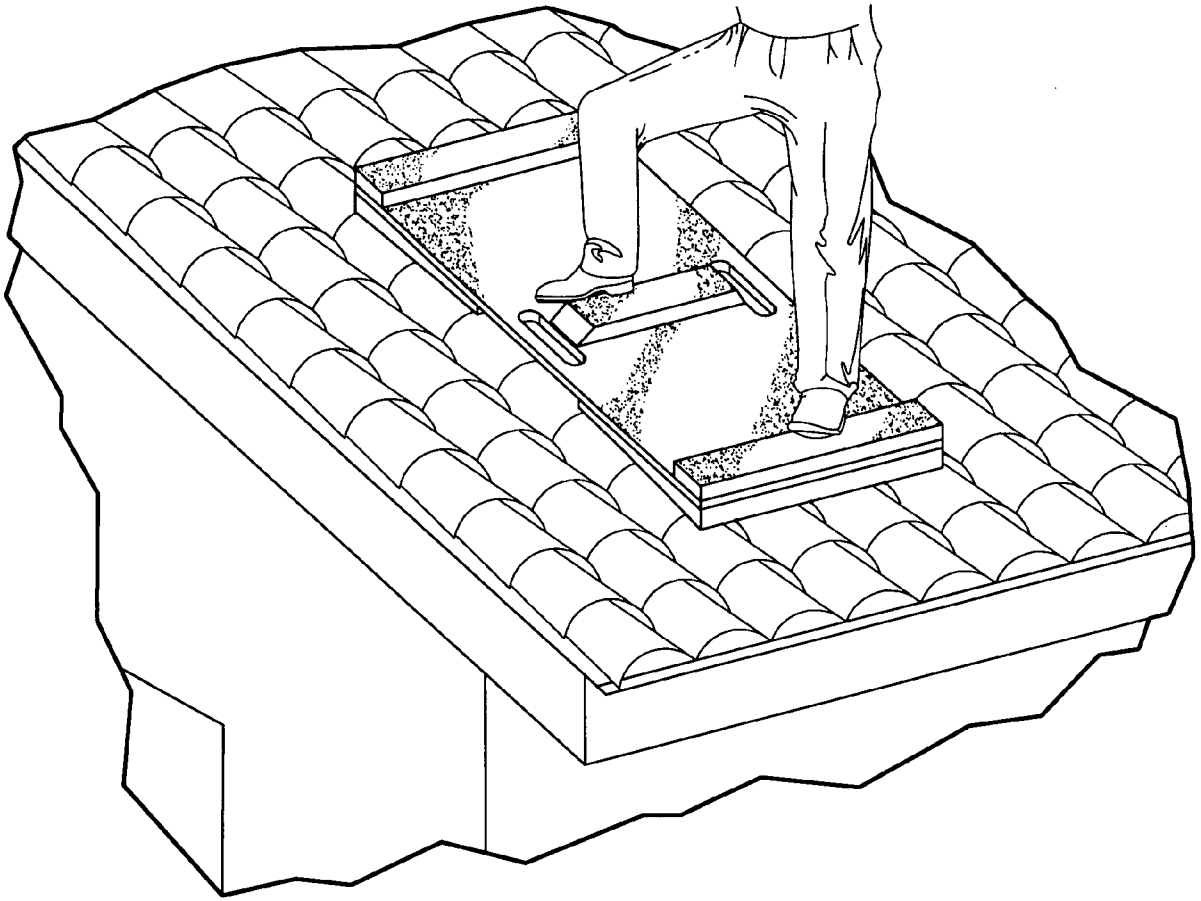
FIG. 9 is a perspective view of a roof of a building structure, with parts broken away, together with an alternative embodiment of the support pad apparatus of the present invention, showing the placement of the person's feet on the cleats and the person's body orientation.

In an alternative embodiment of the present invention shown in FIGS. 8 and 9, additional means are provided to strengthen platform 17 and to provide additional anti-slip support, include the use of ladder steps or cleats 100, 102, and 104, secured to the upper surface 26 of platform 17. Cleats 100, 102 and 104 need not be large. A nominal 1 inch by 2 inch (actual ¾ inch by 1½ inch) strip of wood lumber or any other suitable natural or synthetic material is sufficient for this purpose. Cleats 100 and 104 extend the full width of the platform. Cleat 102 is installed between handholds 90 and 92 and thus is shorter in length. Each cleat as well as the entire top surface of platform 17 may also be coated with the high-friction grit material 108 to further minimize foot slippage.

Cleats 100, 102 and 104 are secured in place using any suitable means, including, without limitation, nuts and bolts, or any strong adhesive.

A person usually requires at least two support pads when walking or working on any type of underlying surface, whether inside a building or in any kind of outside environment. In this application, the person typically stands on one support pad while deploying a second ahead of the first. If necessary to proceed across the underlying, surface, the person normally would step to the second support pad and deploys the first pad as the next one in the sequence. In this way, a person can reach the area where the person is intending to perform the work without directly stepping on the underlying surface.

There may be situations in which a person may wish to move up and down a section the underlying surface without having to reposition the support pads in the process. Illustrative of this is FIG. 6, which shows several support pad apparatuses 10 connected end-to-end on a sloped roof.

The preferred means to interconnect several support pads, either vertically or horizontally, across the underlying surface is to employ mateable VELCRO® fastener strips attached to each end of a support pad (see FIGS. 1 through 6). Interlinking hook and loop fasteners 80 and 82 are thus used for this purpose. Other types of conventional attachment means may also be suitable.

Fastener 106 is affixed against either the front or back end of each pad and used to hold another fastener out of the way, such as fastener 82, when fastener 82 is not being used to interlink support pads. To achieve this, fastener 82 is simply folded down and pressed against fastener 106 (FIG. 10), to hold fastener 82 in place.

This invention has been described in its presently preferred embodiment, and it is clear that it is susceptible to numerous modifications, modes and embodiments within the ability of those skilled in the art and without the exercise of this inventive faculty.

The invention claimed is:

1. A support pad apparatus for distribution of weight loads upon a sloped underlying surface, comprising:

a platform, said platform having first and second side edges, a front end and a back end, a top working surface and a bottom surface, and one or more horizontally disposed grooved slotted openings integrally cut into said platform for supporting a person's foot to compensate for the slope of the underlying surface and enabling the generally horizontal orientation of a person's body appropriately tangential to the slope of the underlying surface, each of said grooved openings having end portions and an opening at each said end portion and first and second edge portions;

a resilient pad attached to said bottom surface, said resilient pad having a top surface and a flexible concave bottom surface for substantially conforming to the shape of said underlying surface and eliminating any unsettling fulcrum effects; and, said resilient pad and said platform being joined and configured to receive and distribute a weight load over said top working surface to protect against damage to said underlying surface; a member slidably inserted into each said grooved slotted opening in mateable relation.

2. The support pad apparatus of claim 1 having a means for attaching at said front end and at said back end one said support pad apparatus to a second support pad apparatus.

3. The support pad apparatus of claim 2 wherein said means for attaching said one support pad apparatus to said second support pad apparatus comprises a hook and loop fastener having interconnecting means comprising a hook component and a loop component.

4. The support pad apparatus of claim 1 wherein each said grooved slotted opening has gradually tapering sides with one said end of said grooved slotted opening having a narrower width than the width of said grooved slotted opening at the opposite said end.

5. The support pad apparatus of claim 1 wherein each said slidably insertable member is tapered in conformal relationship with each said corresponding grooved slotted opening.

6. The support pad apparatus of claim 1 having a means for confining said insertable member within said grooved slotted opening.

7. The support pad apparatus of claim 6 wherein said means for confining said insertable member within said grooved slotted opening comprises a strap-like loop fastener with mateable said hook and loop components disposed across the wider of said two end portions of said grooved slotted opening.

8. The support pad apparatus of claim 1 wherein said platform includes one or more handholds.

9. The support pad apparatus of claim 8 wherein said handholds are formed within said platform along said first and second side edges.

10. The support pad apparatus of claim 3 wherein said hook component of one said hook-and-loop fastener is attached to one end of said one support pad apparatus and a corresponding loop component of a second said hook-and-loop fastener is attached to one end of said second support pad apparatus, said fasteners joining to connect said two support pad apparatuses.

11. The support pad apparatus of claim 1 wherein said top working surface includes a means for providing foot traction.

12. The support pad apparatus of claim 1 wherein said bottom surface of said platform is concave.

13. The support pad apparatus of claim 12 wherein said top surface of said resilient pad is convex.

14. The support pad apparatus of claim 13 wherein said concave bottom surface of said platform and said convex top surface of said resilient pad join in conformal relationship.

15. The support pad apparatus of claim 1 wherein said resilient pad comprises a synthetic polymer composition foam material.

16. A support pad apparatus for distributing a weight load upon a hard or soft underlying sloped, uneven or level surface, comprising:

a platform, said platform having first and second side edges, a front end and a back end, a top working surface and a bottom surface, and one or more horizontally disposed grooved slotted openings integrally cut into said platform for supporting a person's foot to compensate for an uneven or sloped underlying surface and enabling the generally horizontal orientation of a person's body appropriately tangential to the sloped or uneven underlying surface, each said grooved slotted opening having an opening at each end with converging edge portions formed along each said side;

a mateable member slidably inserted into each said grooved slotted opening in conformal relationship;

a resilient pad attached to said bottom surface, said resilient pad having a top surface and a flexible bottom surface adapted to substantially conform to the shape of said underlying surface; and, said resilient pad and said platform being joined and configured to receive and distribute a weight load over said platform and said pad to protect against damage to said underlying surface.

* * * * *